US005986195A

United States Patent [19]

Liao

[11] Patent Number: 5,986,195

[45] Date of Patent: Nov. 16, 1999

[54] MUSICAL RESONATOR MOUNTING STRUCTURE

[75] Inventor: Tsun-Chi Liao, Taichung, Taiwan

[73] Assignee: HWA Shin Musical Instruments Co., Ltd., Taichung, Taiwan

[21] Appl. No.: 09/050,034

[22] Filed: Mar. 30, 1998

[51] Int. Cl.[6] ..... G10D 13/00; G10D 13/02

[52] U.S. Cl. ..... 84/410; 84/402; 84/411 R; 84/415; 84/422.1

[58] Field of Search ..... 84/402–403, 410, 84/411 R, 422.1, 422.2, 415–417

[56] References Cited

U.S. PATENT DOCUMENTS 5,616,875 4/1997 Lombardi ..... 84/415

5,844,157 12/1998 Kasha ..... 84/415

*Primary Examiner*—Robert E. Nappi
*Assistant Examiner*—Marlon Fletcher
*Attorney, Agent, or Firm*—Bacon & Thomas

[57] ABSTRACT

A musical resonator mounting arrangement includes a resonator unit, a support plate, a coupling plate having one end fastened to the support plate and an opposite end connected to an end plate of the resonator unit by a connecting plate, a clamping unit controlled to secure the support plate to a musical instrument, enabling corrugated metal wires of the resonator unit to be retained in contact with the musical instrument, and an adjustment screw fastened to the support plate and the coupling plate at one end and screwed up with an adjustment nut for adjusting the contact pressure between the musical instrument and the corrugated metal wires of the resonator unit.

3 Claims, 11 Drawing Sheets

MUSICAL RESONATOR MOUNTING STRUCTURE

BACKGROUND OF THE INVENTION

The present invention relates to a musical resonator mounting structure, and more particularly to such a musical resonator mounting structure which can be conveniently mounted on a musical instrument, and adjusted to keep corrugated metal wires of resonator unit in contact with the musical instrument.

FIGS. 1 and 2 show a musical resonator mounting structure installed in a drum according to the prior art. This musical resonator mounting structure comprises a resonator unit, two holder plates, and an adjustment device. The holder plates are fastened to the drum at two opposite sides. The adjustment device is mounted on one holder plate, comprised of a link and a lever. The resonator unit comprises a first end plate fixedly fastened to one holder plate, a second end plate fastened to the link of the adjustment device, and a plurality of corrugated metal wires connected in parallel between the end plates and arranged at the bottom side of the drum. By means of operating the lever of the adjustment device to lift the link, the corrugated metal wires of the resonator unit are stretched and closely attached to the bottom side of the drum, as shown in FIG. 1, therefore the corrugated metal wires are vibrated when the drum is played by beating. When the lever of the adjustment device is operated to lower the link, the corrugated metal wires of the resonator unit are released and disconnected from the bottom side of the drum, as shown in FIG. 2. This musical resonator mounting structure has drawbacks. Because the length of the corrugated metal wires of the resonator unit is approximately equal to the diameter of the drum, much metal material is used for making the corrugated metal wires. Another drawback of this musical resonator mounting structure is the complicated procedure of processing mounting holes on the frame of the drum for mounting the holder plates. Furthermore, the manufacturing cost of the adjustment device is high, and its installation procedure is complicated.

SUMMARY OF THE INVENTION

It is one object of the present invention to provide a musical resonator mounting structure which can be conveniently installed in a musical instrument and adjusted to the desired position. It is another object of the present invention to provide a musical resonator mounting structure which greatly diminishes material for the resonator unit, and reduces its manufacturing cost. To achieve these and other objects of the present invention, there is provided a musical resonator mounting structure which comprises a resonator unit, a support plate, a coupling plate having one end fastened to the support plate and an opposite end connected to an end plate of the resonator unit by a connecting plate, a clamping unit controlled to secure the support plate to a musical instrument, enabling corrugated metal wires of the resonator unit to be retained in contact with the musical instrument, and an adjustment screw fastened to the support plate and the coupling plate at one end and screwed up with an adjustment nut for adjusting the contact pressure between the musical instrument and the corrugated metal wires of the resonator unit.

DETAILED DESCRIPTION OF THE PREFERRED EMBODIMENT

Figure 1:
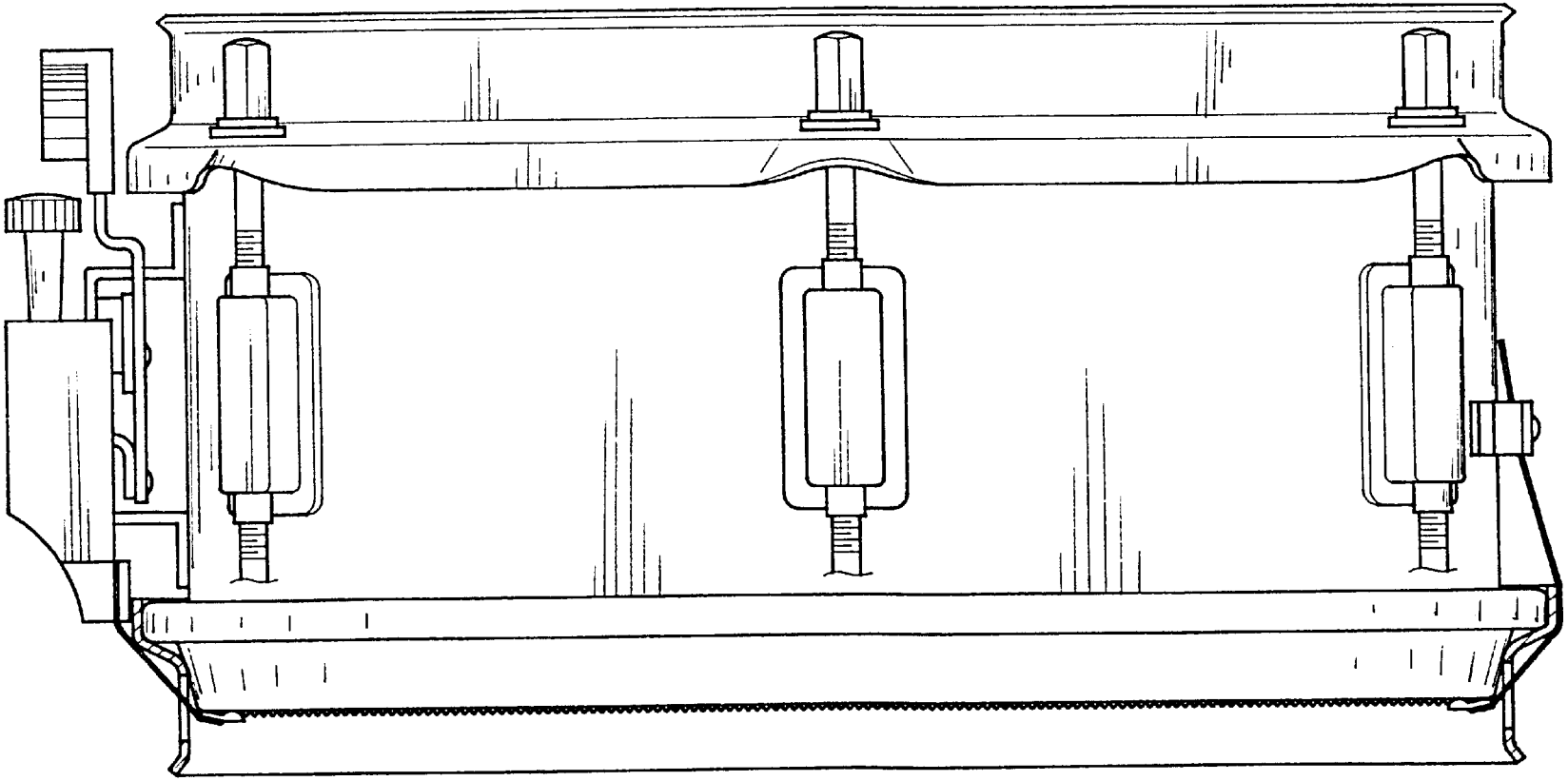
Fig·1 PRIOR ART
FIG. 1 shows a musical resonator mounting structure installed in a drum according to the prior art.
Figure 2:
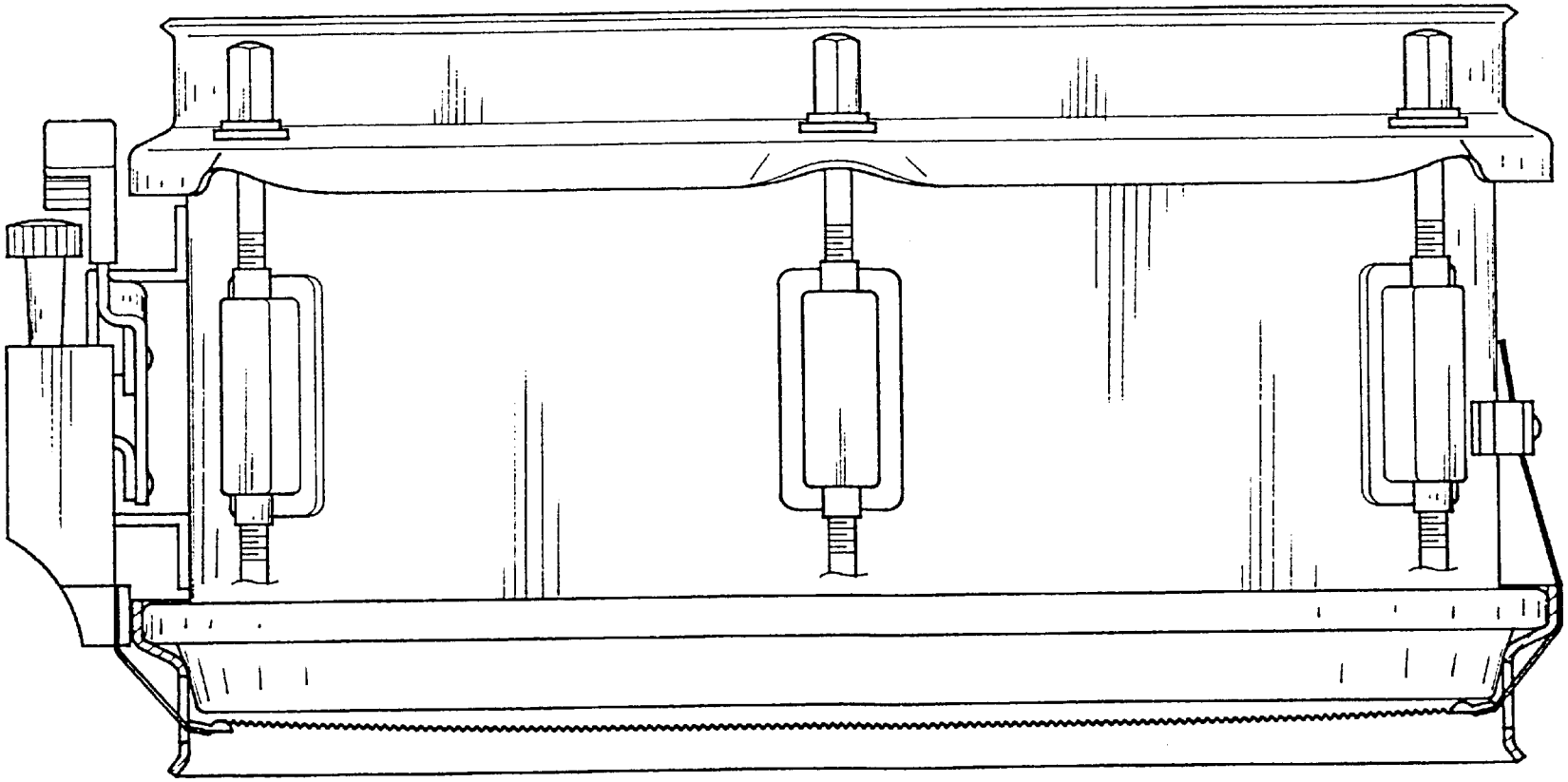
Fig. 2 PRIOR ART
FIG. 2 is similar to FIG. 1 but showing the resonator unit disconnected from the bottom side of the drum.
Figure 3:
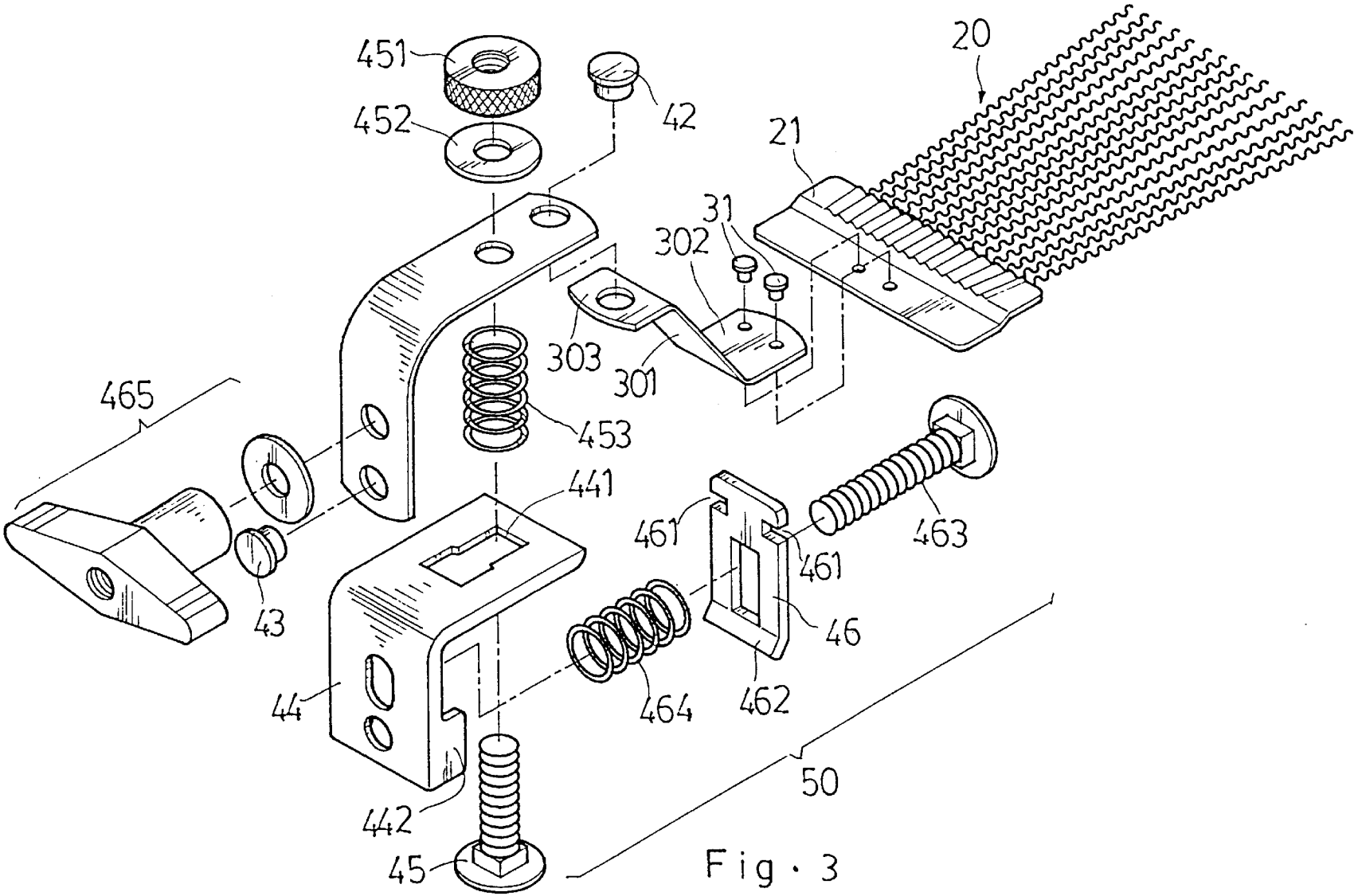
FIG. 3 is an exploded view of a musical resonator mounting structure according to a first embodiment of the present invention.
Figure 4:
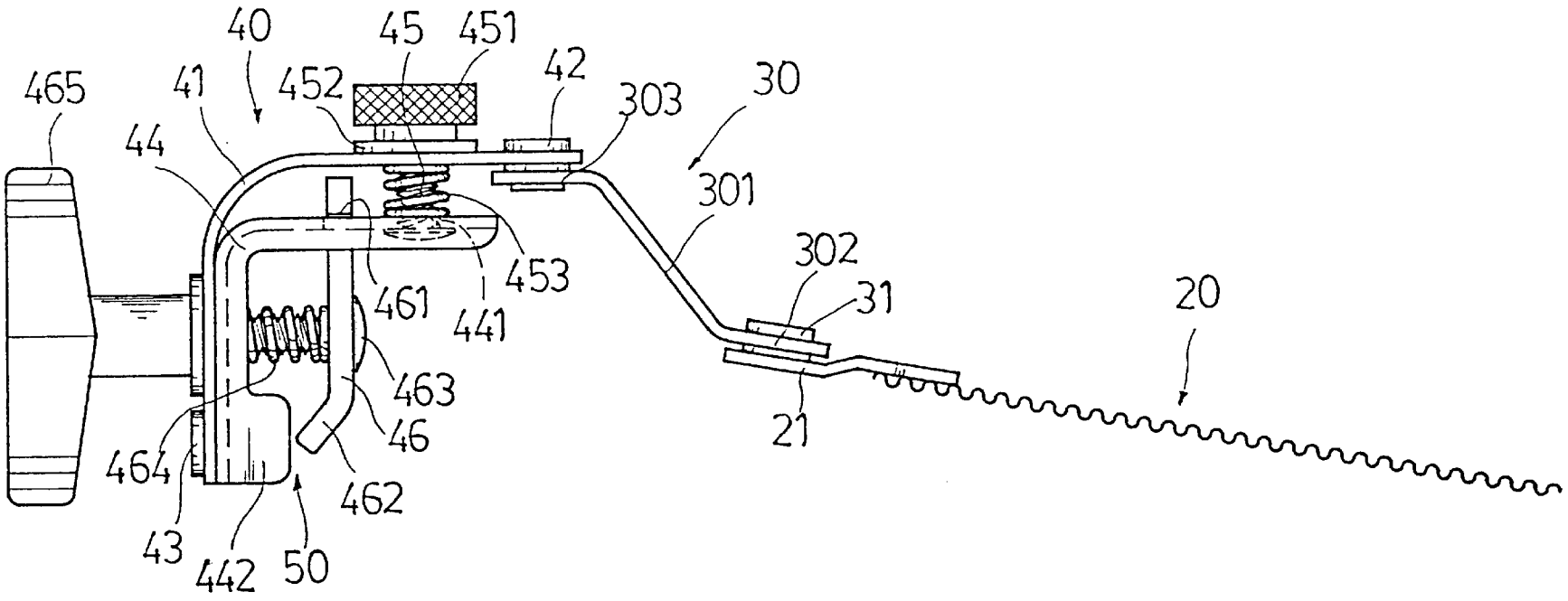
FIG. 4 is a side assembly view of the musical resonator mounting structure shown in FIG. 3.
Figure 7:
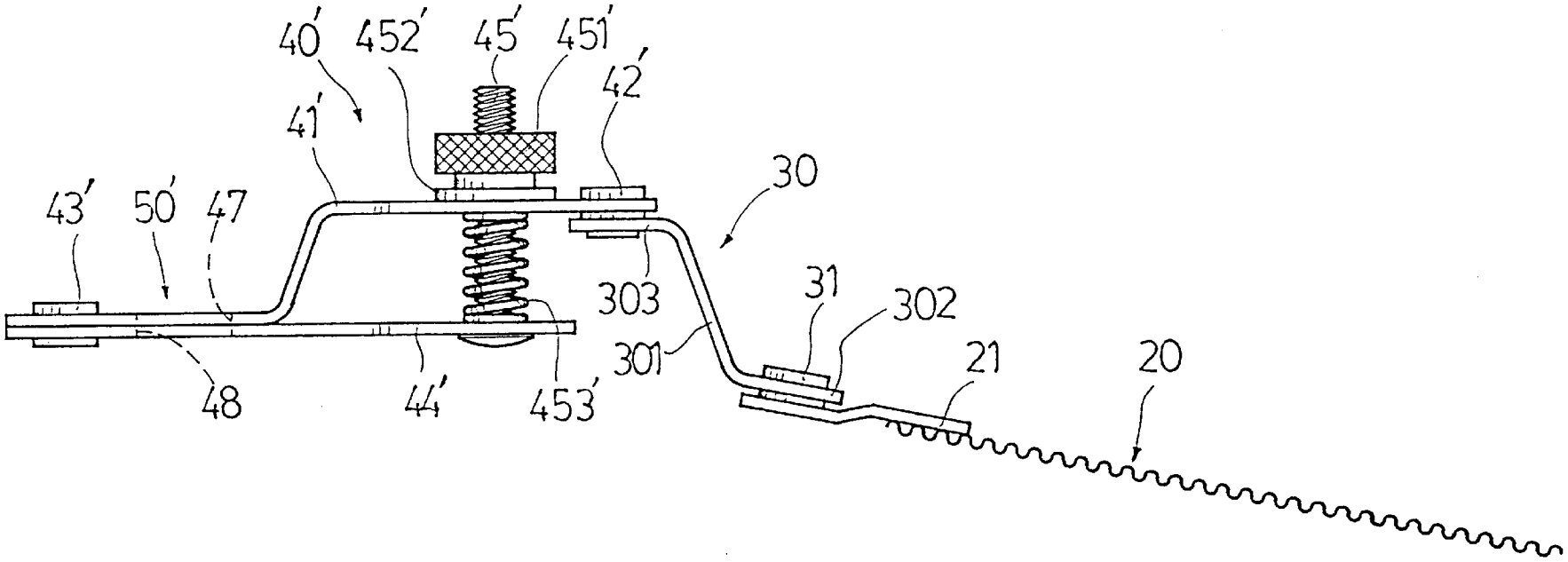
FIG. 7 is a side assembly view of a musical resonator mounting structure according to a second embodiment of the present invention.
Figure 8:
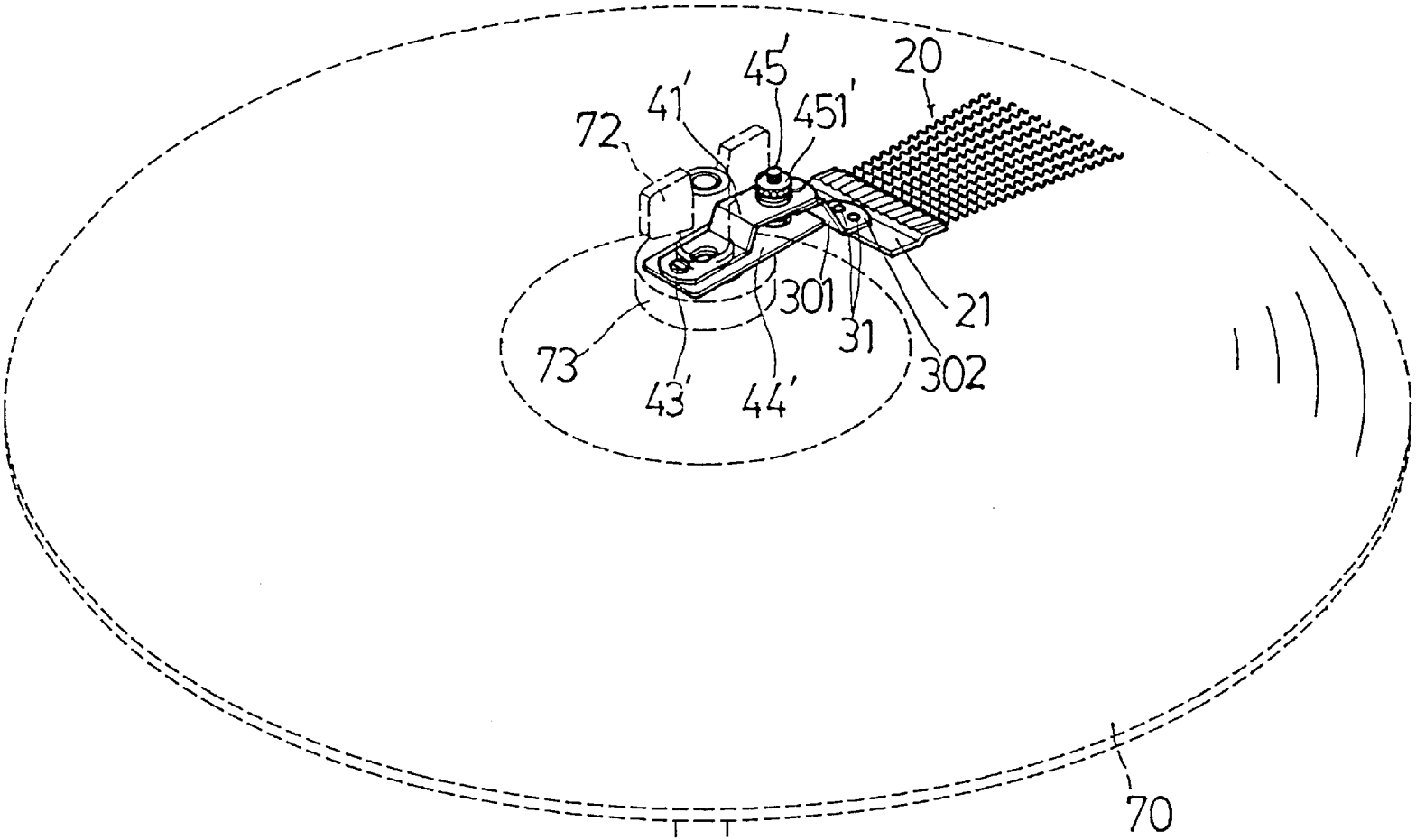
FIG. 8 is a perspective view showing the musical resonator mounting structure of the second embodiment of the present invention mounted on a cymbal stand.
Figure 9A:
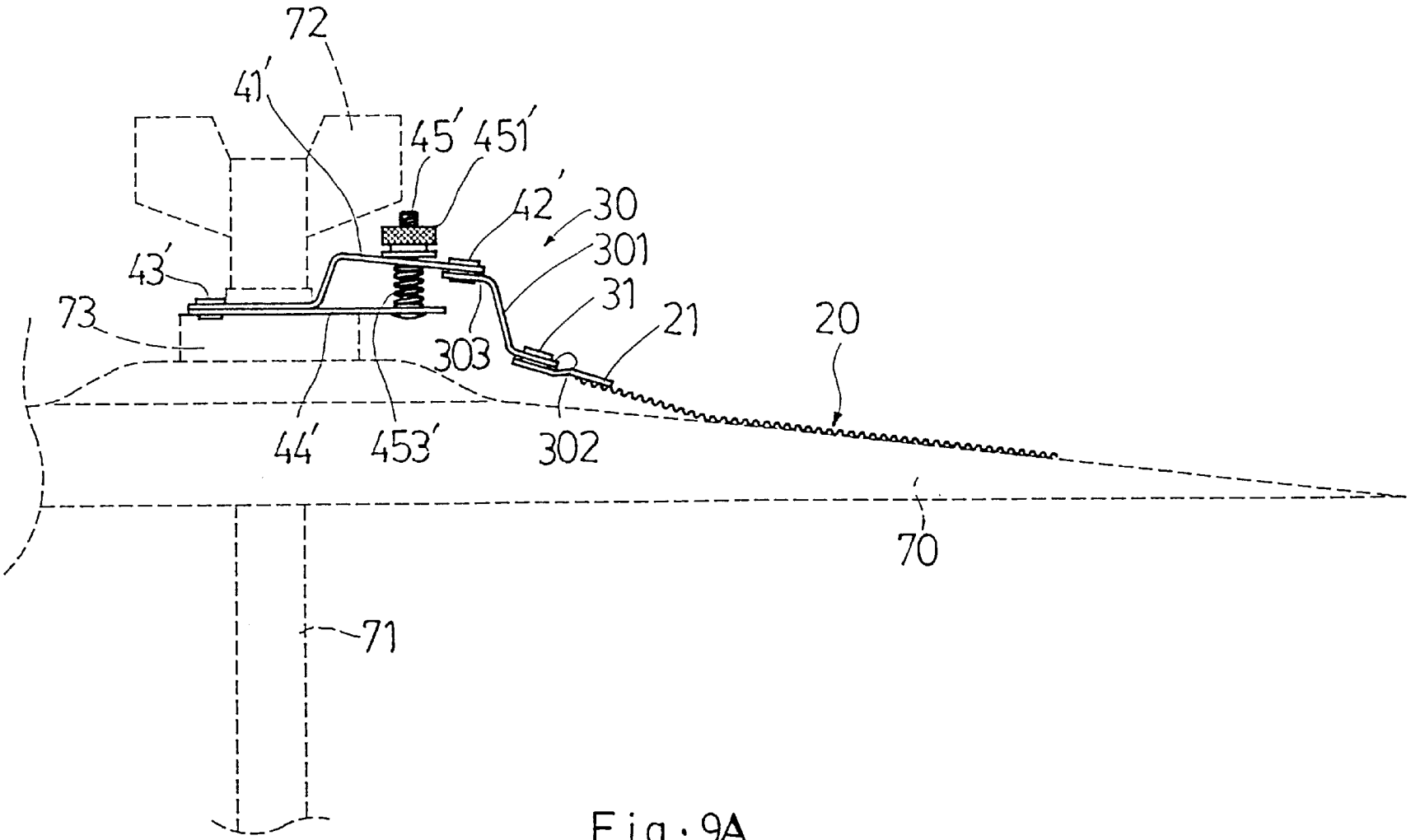
FIG. 9A is a side view of FIG. 8, showing the corrugated metal wires of the resonator unit pressed on the surface of the cymbal.
Figure 9B:
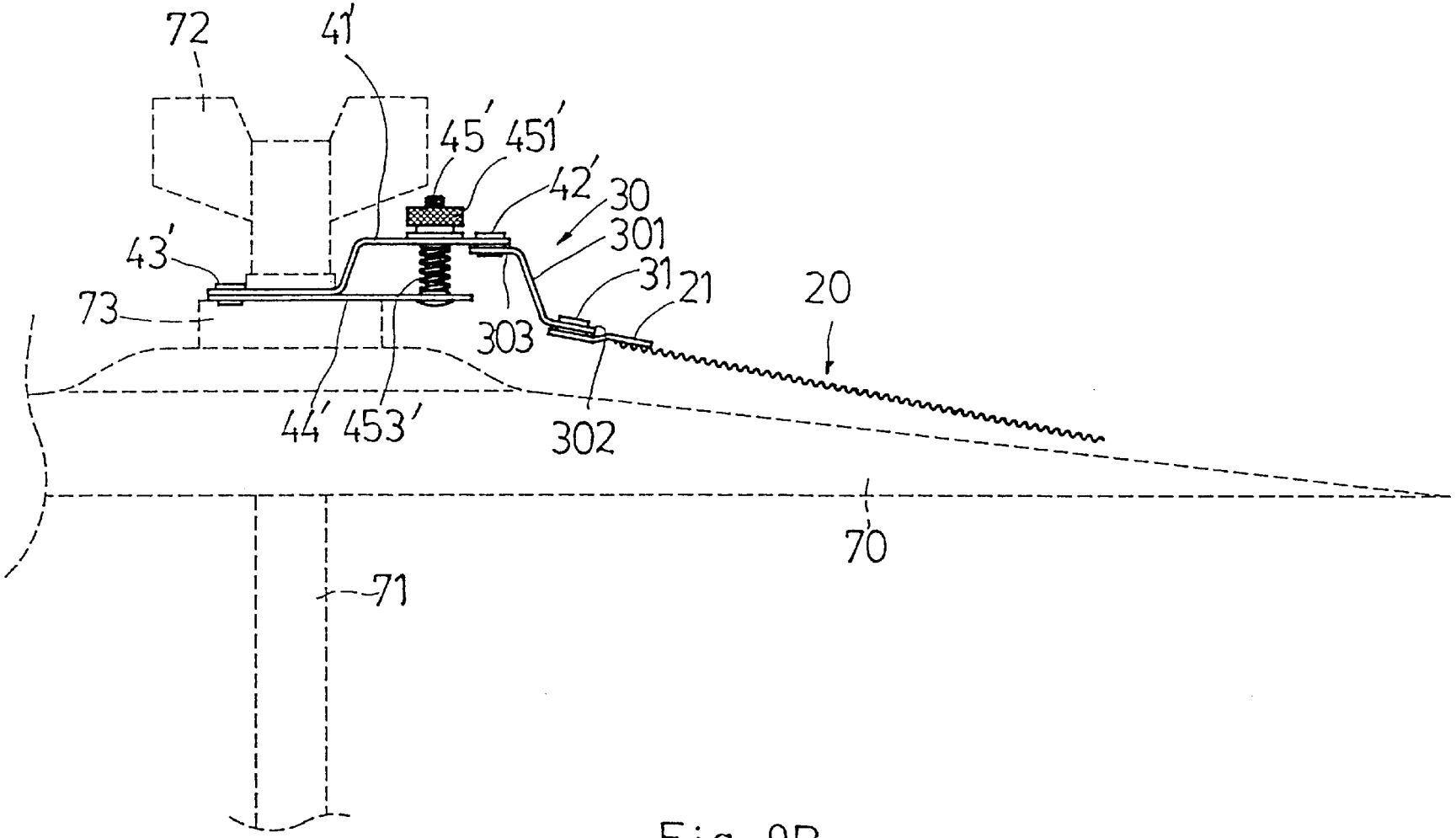
FIG. 9B is similar to FIG. 9A but showing the corrugated metal wires of the resonator unit disconnected from the cymbal.

Referring to FIGS. 3, 4 and 7, a musical resonator mounting structure in accordance with the present invention comprises mainly a resonator unit 20, a connecting plate 30, a resilient holding down unit 40 or 40', and a clamping unit 50 or 50'.

The resonator unit 20 comprises an end plate 21 and a plurality of corrugated metal wires connected in parallel to the end plate 21 by welding.

The connecting plate 30 has an oblique middle portion 301, a first connecting portion 302 extended from one end namely the bottom end of the oblique middle portion 301 and fixedly connected to the end plate 21 of the resonator unit 20 by fastening elements 31, and a second connecting portion 303 extended from the other end namely the top end of the oblique middle section 301.

The resilient holding down unit 40 or 40' comprises an resilient coupling plate 41 or 41' having one end fastened to the second connecting portion 303 of the connecting plate 30 by a fastening element 42 or 42' and an opposite end connected to one end of a support plate 44 or 44' by a fastening element 43 or 43', a support plate 44 or 44' having a fixed end fastened to one end of the resilient coupling plate 41 or 41' remote from the connecting plate 30 and a free end spaced below the resilient coupling plate 41 or 41' and extending toward the connecting plate 30, an adjustment screw 45 or 45' fastened to the free end of the support plate 44 or 44' and one end of the resilient coupling plate 41 or 41', a nut 451 or 451' threaded onto the adjustment screw 45 or 45' to secure the adjustment screw 45 or 45' to the support plate 44 or 44' and the resilient coupling plate 41 or 41', a washer 452 or 452' mounted around the adjustment screw 45 or 45' and retained between the nut 451 or 451' and the resilient coupling plate 41 or 41', and a spring 453 or 453' mounted around the adjustment screw 45 or 45' and stopped between the support plate 44 or 44' and the resilient coupling plate 41 or 41'. When the nut 451 or 451' is rotated inwards, the resilient coupling plate 41 or 41' is forced downwards to compress the spring 453 or 453', and therefore the resonator unit 30 is held down.

The clamping unit 50 or 50' is mounted on the resilient coupling plate 41 or 41' and the support plate 44 or 44' at one end for securing the whole assembly to a musical instrument.

Figure 5:
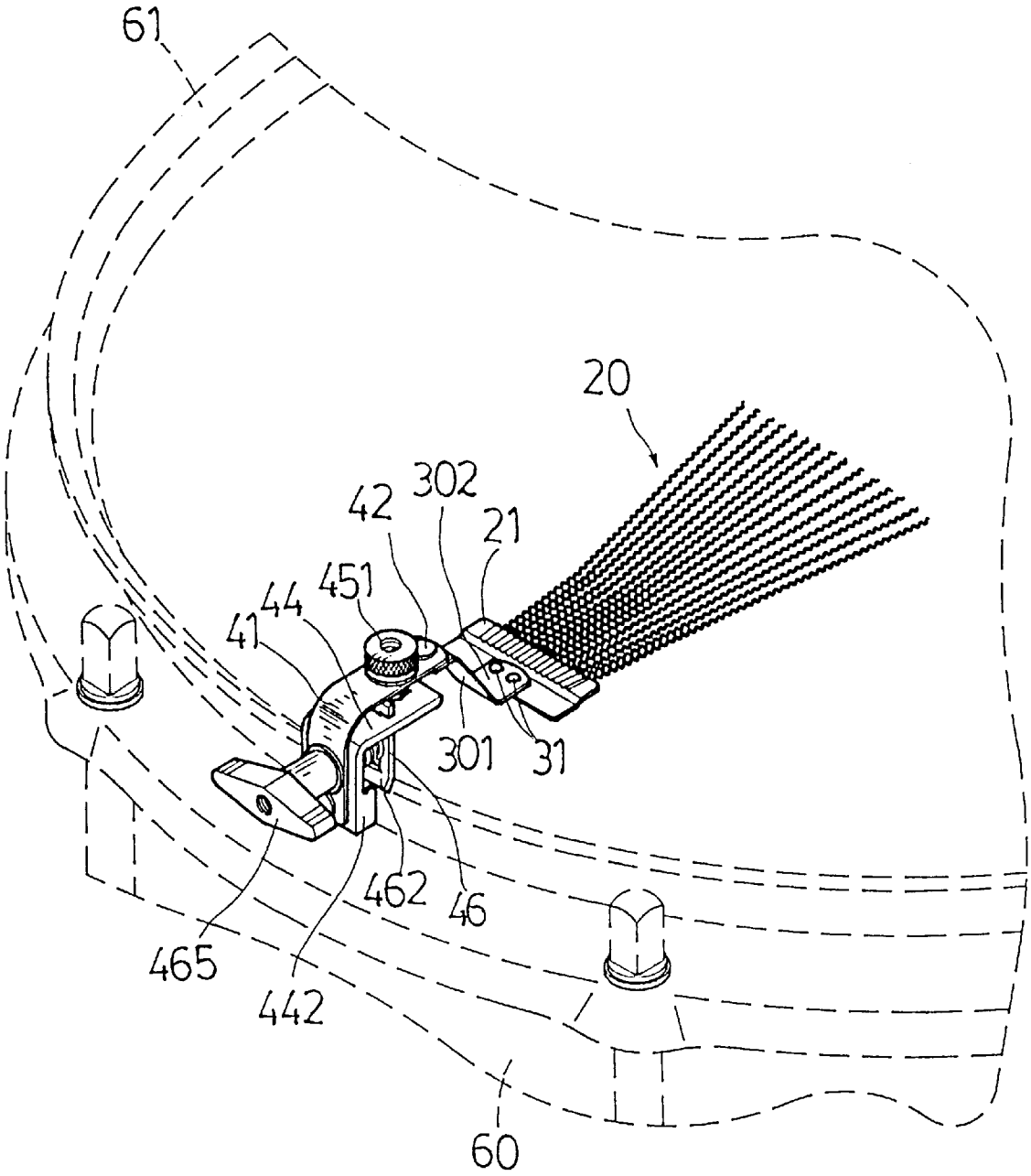
FIG. 5 is a perspective view showing the musical resonator mounting structure of the first embodiment of the present invention installed in a drum.
Figure 6A:
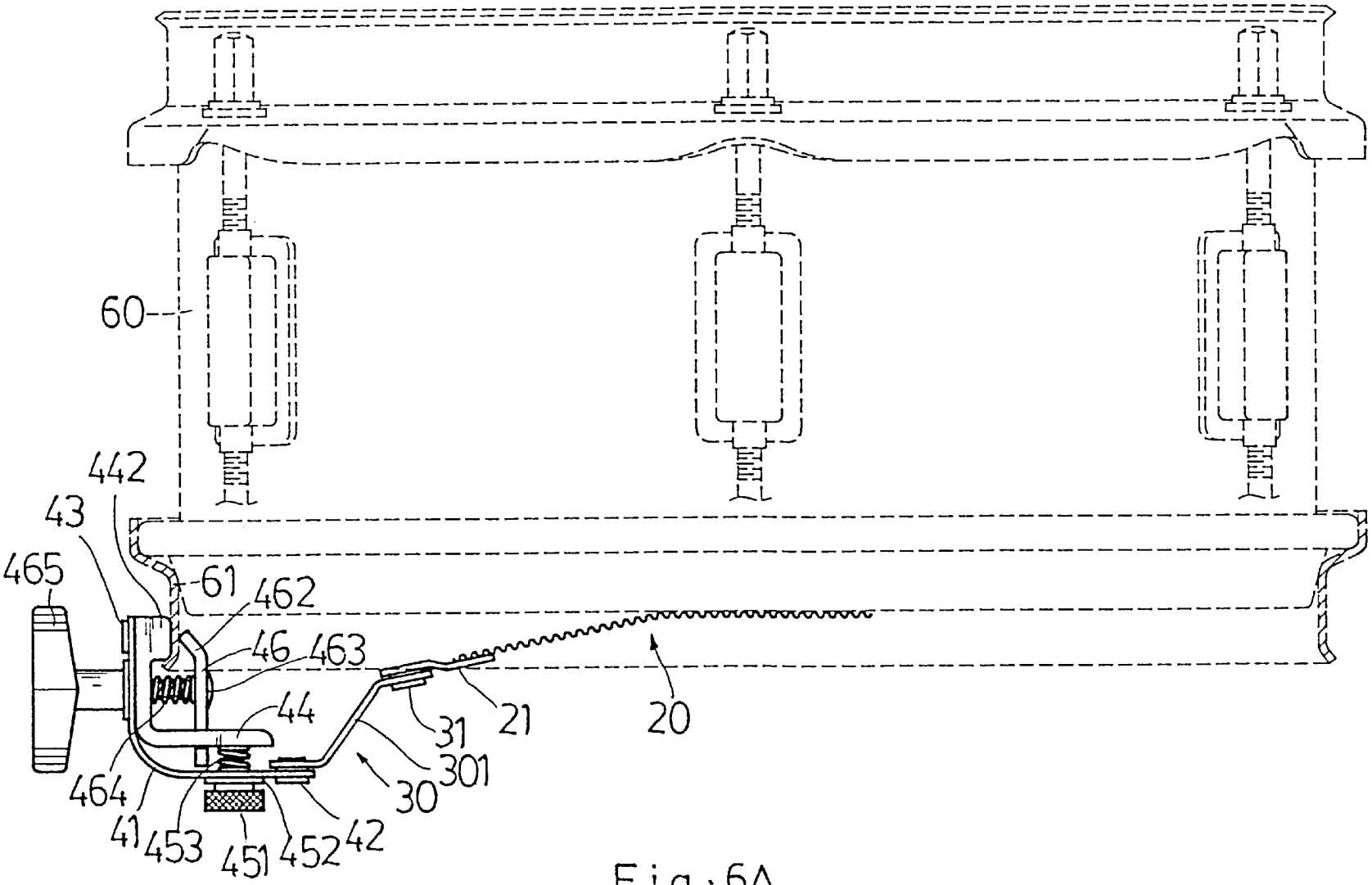
FIG. 6A is a side view of the first embodiment of the present invention, showing the musical resonator mounting structure installed in the bottom side of a drum, the corrugated metal wires of the resonator pressed on the bottom side of the drum.
Figure 6B:
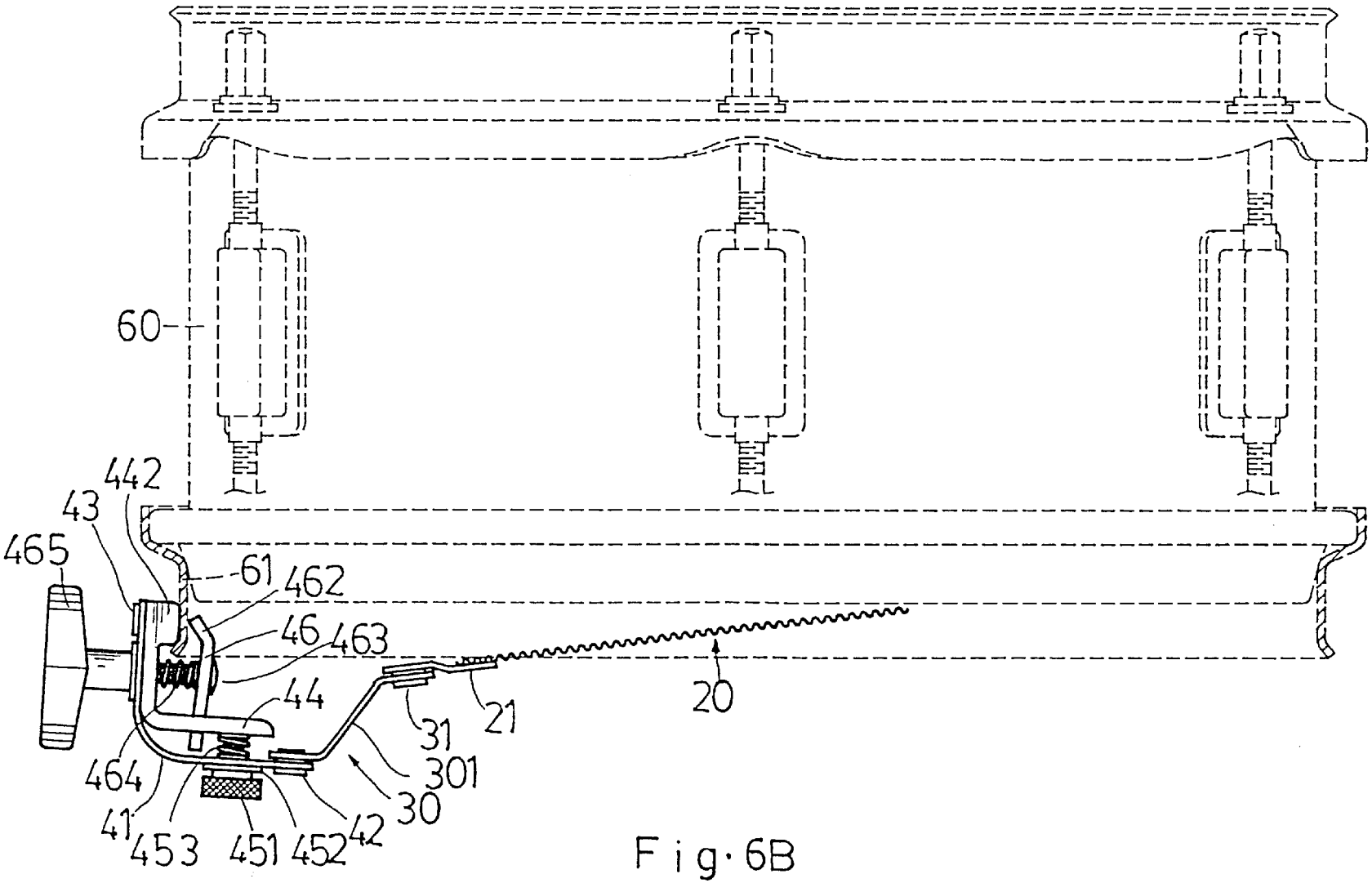
FIG. 6B is similar to FIG. 6A but showing the corrugated metal wires of the resonator released from the bottom side of the drum.

Referring to FIGS. 5, 6A and 6B, and FIGS. 3 and 4 again, the resilient coupling plate 41 and the support plate 44 each have a L-shaped profile. The support plate 44 has an elongated slot 441 at its free end, and two side flanges 442 bilaterally and perpendicularly raised from its fixed end. A clamping plate 46 is inserted through the elongated slot 441 on the support plate 44. The clamping plate 46 comprises two side notches 461 bilaterally disposed at one end namely the top end, and a clamping wall 462 at an opposite end namely the bottom end corresponding to the side flanges 442 of the support plate 44. When the top end of the clamping plate 46 is inserted through the elongated slot 441 on the support plate 41, the clamping plate 46 is rotated horizontally through 90°, enabling the side notches 461 to be coupled to two opposite side walls of the elongated slot 441 on the support plate 44, and therefore the clamping plate 46 is coupled to the support plate 44. The adjustment screw 45 is inserted through the elongated slot 441 on the support plate 44, the spring 453, a through hole on the resilient coupling plate 41 and the washer 452, and then screwed up with the nut 451. A screw 463 is inserted through a hole on the clamping plate 46, a hole on the support plate 44 and a hole on the resilient coupling plate 41, and then screwed up with a wing nut 465. A spring 464 is mounted around the screw 463 and retained between the support plate 44 and the clamping plate 46. The clamping plate 46, the screw 463, the wing nut 465 and the side flanges 442 of the support plate 44 form the clamping unit 50. When installing the whole assembly in a musical instrument for example a drum 60, the bottom counterhoop 61 of the drum 60 is inserted into the gap between the side flanges 442 of the support plate 44 and the clamping wall 462 of the clamping plate 46, permitting the resonator unit 20 to be extended to the bottom side of the drum 60, and then the wing nut 465 is rotated in one direction to move the screw 463 toward the wing nut 465, and therefore the clamping wall 462 of the clamping plate 46 and the side flanges 442 of the support plate 44 are clamped on the bottom counterhoop 61 of the drum 60 at both sides. When the wing nut 465 is fastened tight, the clamping wall 462 of the clamping plate 46 is pulled toward the side flanges 442 of the support plate 44, and at the same time the support plate 44 and the resilient coupling plate 41 are stretched to force the resonator unit 20 against the bottom side of the drum 60, enabling vibration waves to be transmitted to the corrugated metal wires of the resonator unit 20. Therefore, the contact pressure between the corrugated metal wires of the resonator unit 20 and the drum can be conveniently adjusted to turning the wing nut 465. When the wing nut 465 is loosened from the screw 463, the gap between the clamping wall 462 of the clamping plate 46 and the side flanges 442 of the support plate 44 is relatively increased, and the stretching force is released from the support plate 44 and the resilient coupling plate 41, and therefore the resonator unit 20 is lowered to disconnect its corrugated metal wires from the bottom side of the drum 60.

Referring to FIGS. 7, 8, 9A and 9B, the coupling plate 41' of the holding down unit 40' has an oblique middle portion and two horizontal end portions extended from two opposite ends of the oblique middle portion in reversed directions. The horizontal top end portion of the coupling plate 41' is fastened to the connecting plate 30. The horizontal bottom end portion of the coupling plate 41' is fastened to the fixed end of the support plate 44'. The support plate 44' is a flat plate. The fixed end of the support plate 44' is closely attached to the horizontal bottom end portion of the coupling plate 41'. The free end of the support plate 44' is spaced below the horizontal top end portion of the coupling plate 41'. The adjustment screw 45' is inserted through a hole on the free end of the support plate 44' and a hole on the horizontal top end portion of the coupling plate 41' and screwed up with the nut 451'. Through holes 47;48 are respectively provided at the horizontal bottom end portion of the coupling plate 41' and the fixed end of the support plate 44'. During installation, the cymbal stand 71 is inserted through the through holes 47;48, and a lock nut 72 is threaded onto the threaded top end of the cymbal stand 71 to fix a cymbal 70 to the cymbal stand 71, and simultaneously to fix the coupling plate 41' and the support plate 44' to the cymbal stand 71. After installation, the nut 451' is turned inwards on the adjustment screw 45' to force down the horizontal top end portion of the coupling plate 41' against the spring 453', and therefore the resonator unit 20 is forced to press its corrugated metal wires on the surface of the cymbal 70. On the contrary, when the nut 451' is turned outwards, the spring 453' is released, and the horizontal top end portion of the coupling plate 41' is forced upwards by the spring 453', and therefore the resonator unit 20 is lifted to disconnect its corrugated metal wires from the cymbal 70.

What the invention claimed is:

1. A musical resonator mounting structure comprising:

a resonator unit, said resonator unit comprising an end plate and a plurality of corrugated metal wires connected in parallel to said end plate;

a connecting plate, said connecting plate having an oblique middle portion, a first horizontal connecting portion extended and a second horizontal connecting portion respectively extended from both ends of said oblique middle portion, said first horizontal connecting portion being fixedly connected to said end plate of said resonator unit;

a resilient holding down unit, said resilient holding down unit comprising an resilient coupling plate having a first end fixedly fastened to the second connecting portion of said connecting plate and a second end, a support plate having a fixed end fastened to the second end of said resilient coupling plate and a free end spaced below the first end of said resilient coupling plate, an adjustment screw fastened to the free end of said support plate and the first end of said resilient coupling plate, an adjustment nut threaded onto said adjustment screw to secure said adjustment screw to said support plate and said resilient coupling plate, and a spring mounted around said adjustment screw and stopped between said support plate and said resilient coupling plate, said spring imparting an outward pressure to push the first end of said resilient coupling plate outwards from the free end of said support plate; and a clamping unit for securing said support plate and said resilient coupling plate to a musical instrument, enabling the corrugated metal wires of said resonator unit to be maintained in contact with the musical instrument; and wherein said support plate is a L-shaped plate having a vertical portion at one end and a horizontal portion at an opposite end; said resilient coupling plate is a L-shaped plate having a vertical portion at one end fixedly fastened to the vertical portion of said support plate, and a horizontal portion at an opposite end vertically spaced from the horizontal position of said support plate at a distance; and wherein said clamping unit comprises an elongated slot on the horizontal portion of said support plate, a clamping plate coupled to the elongated slot on said support plate, said clamping plate having a clamping wall at one end remote from said support plate, a screw inserted through a hole on said clamping plate, a hole on the vertical portion of said support plate and a hole on the vertical portion of said resilient coupling plate, two side flanges bilaterally raised from the vertical portion of said support plate, a spring mounted around the screw of said clamping unit and stopped between said clamping plate and said support plate, and a wing nut threaded onto the screw of said clamping unit to pull said clamping wall of said clamping plate toward said side flanges, enabling said side flanges and said clamping wall of said clamping plate to be clamped on two opposite sides of a bottom counterhoop of a drum.

2. The musical resonator mounting structure of claim 1, wherein said resilient coupling plate of said holding down unit has an oblique middle portion, a horizontal top end portion and a horizontal bottom end portion respectively extended from two opposite ends of the oblique middle portion of said resilient coupling plate in reversed directions, the horizontal top end portion of said resilient coupling plate being fastened to said connecting plate, the horizontal bottom end portion of said resilient coupling plate being fastened to the fixed end of said support plate; said support plate is a flat plate having a fixed end attached to the horizontal bottom end portion of said resilient coupling plate, and a free end suspending below the horizontal top end portion of said coupling plate; said adjustment screw is inserted through a hole on said support plate and a hole on the horizontal top end portion of said coupling plate and screwed up with said adjustment nut.

3. The musical resonator mounting structure of claim 2, wherein through holes are respectively provided at the horizontal bottom end portion of said coupling plate and the fixed end of said support plate through which a cymbal stand is inserted and screwed up with a lock nut to hold a cymbal, enabling the corrugated metal wires of said resonator unit to be retained in contact with said cymbal.

* * * * *